US008582722B2

(12) United States Patent
Tadokoro et al.

(10) Patent No.: US 8,582,722 B2
(45) Date of Patent: Nov. 12, 2013

(54) ROTARY ANODE X-RAY TUBE

(75) Inventors: Chiharu Tadokoro, Tokyo (JP); Yasutaka Ito, Kanagawa-ken (JP); Hitoshi Hattori, Kanagawa-ken (JP); Ryoichi Takahashi, Kanagawa-ken (JP); Tetsuya Yonezawa, Tochigi-ken (JP); Hironori Nakamuta, Tochigi-ken (JP)

(73) Assignees: Kabushiki Kaisha Toshiba, Tokyo (JP); Toshiba Electron Tubes & Devices Co., Ltd, Tochigi-ken (JP)

( * ) Notice: Subject to any disclaimer, the term of this patent is extended or adjusted under 35 U.S.C. 154(b) by 321 days.

(21) Appl. No.: 12/875,559

(22) Filed: Sep. 3, 2010

(65) Prior Publication Data

US 2011/0058654 A1 Mar. 10, 2011

(30) Foreign Application Priority Data

Sep. 8, 2009 (JP) ..... 2009-207424

(51) Int. Cl.
*H01J 35/10* (2006.01)

(52) U.S. Cl.
USPC ..... 378/130; 378/132

(58) Field of Classification Search
USPC ..... 378/130–133, 119, 141
See application file for complete search history.

(56) References Cited

U.S. PATENT DOCUMENTS

| | | | | |
|---|---|---|---|---|
| 4,083,098 | A | 4/1978 | Nicholas | |
| 5,416,820 | A * | 5/1995 | Weil et al. | 378/130 |
| 5,838,763 | A | 11/1998 | Hiller et al. | |
| 2002/0006183 | A1 * | 1/2002 | Ide | 378/133 |
| 2009/0080616 | A1 * | 3/2009 | Yoshii et al. | 378/133 |

FOREIGN PATENT DOCUMENTS

| | | |
|---|---|---|
| JP | 2003-077412 | 3/2003 |
| JP | 3467292 | 8/2003 |
| JP | 2004-063444 | 2/2004 |
| JP | 4112829 | 4/2008 |
| JP | 2009-130035 | 6/2009 |

OTHER PUBLICATIONS

Japanese Office Action for Japanese Application No. 2009-207424 mailed on Jul. 23, 2013.

* cited by examiner

*Primary Examiner* — Hoon Song
(74) *Attorney, Agent, or Firm* — Turocy & Watson, LLP

(57) ABSTRACT

A rotary anode X-ray tube apparatus according to an embodiment of the present invention includes a stationary shaft, a cooling bath that is provided in the stationary shaft, a rotary cylinder that is rotatably supported to the stationary shaft, a target that is provided in the rotary cylinder, a cathode that is disposed to face the target, and a vacuum enclosure that stores these components. The stationary shaft has a large-diameter portion provided in a portion thereof and is provided with a flow passage through which a cooling fluid flows. The cooling bath is provided by thinning the wall thickness of the large-diameter portion to increase the flow passage diameter of a portion of the flow passage. The rotary cylinder covers an area of the stationary shaft including the large-diameter portion through a liquid metal and is rotatably supported to the stationary shaft. The target has a hollow circular plate shape that is provided on an outer circumferential surface of the rotary cylinder. The vacuum enclosure stores the stationary shaft, the rotary cylinder, the target, and the cathode and supports the stationary shaft.

2 Claims, 10 Drawing Sheets

ROTARY ANODE X-RAY TUBE

CROSS REFERENCE TO RELATED APPLICATIONS

This application is based upon and claims the benefit of priority from the prior Japanese Patent Application No. 2009-207424 filed in Japan on Sep. 8, 2009; the entire contents of which are incorporated herein by reference.

FIELD

Embodiments described herein relate generally to a rotary anode X-ray tube that is provided with a hydrodynamic bearing rotatably supporting a target.

BACKGROUND

Rotary anode X-ray tube apparatuses are used in medical and industrial diagnosis systems that are represented by computed tomography (CT) apparatuses. In general, a rotary anode X-ray tube apparatus includes a rotary anode X-ray tube that radiates X-rays, a stator coil, and a casing that stores the rotary anode X-ray tube and the stator coil.

A conventional rotary anode X-ray tube includes a stationary shaft that has a flange portion provided in a portion thereof, a rotary anode that is rotatably provided in the stationary shaft, a cathode that is disposed to face the rotary anode, and a vacuum enclosure that stores the stationary shaft, the rotary anode, and the cathode and partially has a transmissive window. The rotary anode X-ray tube has a cantilevered structure where the stationary shaft is supported to one side of the vacuum enclosure.

The rotary anode includes a rotary cylinder of a cylindrical shape having a bottom that is provided to cover a portion from a front end of the stationary shaft to the flange portion with a gap, a target (anode) of a hollow circular plate shape that is provided on a front end of the rotary cylinder, a motor rotor that is provided on a side of the rotary cylinder, and a thrust ring that is provided in an opening of the rotary cylinder. The target and the rotary cylinder may be separated components.

A liquid metal is filled into a gap of the stationary shaft and the rotary cylinder. The liquid metal works as a lubricant of the hydrodynamic bearing when the rotary anode rotates. The rotary anode is rotatably supported due to a hydrodynamic effect that is generated in the hydrodynamic bearing.

The hydrodynamic bearing includes a radial bearing that supports the rotary anode in a radial direction and a thrust bearing that supports the rotary anode in an axial direction. In portions that constitute the radial bearing and the thrust bearing, grooves to generate the hydrodynamic effect are provided.

In the conventional rotary anode X-ray tube apparatus, the rotary anode is rotated by generating a magnetic field in the motor rotor by the stator coil. In this state, electronic beams are irradiated from the cathode to the target. If electrons collide with the target, X-rays are discharged from a transmissive window provided in the vacuum enclosure to the outside.

When the electronic beams are irradiated onto the target, the X-rays are generated as described above, but heat is also simultaneously generated. Accordingly, the temperature of the target, particularly on an electron colliding surface (focus) where the electrons collide, becomes locally high. The electron colliding surface is instantly destroyed due to the impact of the locally raised temperature of the surface, that is thermal shock. For this reason, in the conventional rotary anode X-ray tube apparatus, the heat input to the target is dispersed by rotating the target. Dispersing the heat input prevent the electron colliding surface from being severely damaged. As such, the X-ray tube that rotates the target (anode) is called the rotary anode X-ray tube. In the description below, the rotary anode X-ray tube is simply called the X-ray tube.

Even in the X-ray tube where the target rotates, if the electronic beams are continuously irradiated for a certain amount of time, the heat is accumulated in the target. If the heat accumulated in the target exceeds the heat capacity of the target, the temperature of the electron colliding surface gradually increases. If the temperature of the electron colliding surface exceeds its allowable temperature, the surface of the target starts to be damaged. This problem is resolved by increasing a size of the target and increasing the heat capacity. However, as the size of the target increases, the size of the X-ray tube increases, leading to higher weight and manufacturing cost of the X-ray tube. Accordingly, the method that increases the size of the target to resolve the above problem is not a preferable method.

For this reason, development of a technology for cooling the target is being promoted. In the cooling of the target, cooling based on radiation or cooling based on heat transfer is used. In particular, the cooling based on the heat transfer is a method that transmits the heat generated in the rotary anode to the stationary shaft through the liquid metal serving as the lubricant of the hydrodynamic bearing and removes the heat transmitted to the stationary shaft by a cooling fluid flowing in the stationary shaft. In the method that cools the target through the heat transfer, higher cooling efficiency can be obtained as compared with the cooling of the target through the radiation. Accordingly, in recent years, X-ray tubes that can cool the target through the heat transfer are mainly used.

The X-ray tube described above has the cantilevered structure where the stationary shaft is supported to one side of the vacuum enclosure. However, an X-ray tube having a both-end supported structure where the stationary shaft is supported to both facing sides of the vacuum enclosure is also known. Unlike the X-ray tube having the cantilevered structure, the X-ray tube having the both-end supported structure can flow the cooling fluid in one direction. Accordingly, as compared with the X-ray tube having the cantilevered structure, the X-ray tube having the both-end supported structure needs a smaller flow passage diameter in flowing a cooling fluid of the same flow volume, and therefore, has an advantage that bending rigidity of the stationary shaft can be enhanced. Since the stationary shaft is supported to both ends, the stationary shaft is rarely bent and deformed, even when a high load is applied to the stationary shaft.

In the conventional X-ray tube described above, the rotary anode is supported by the hydrodynamic effect. In order to generate the hydrodynamic effect, the stationary shaft and the rotary cylinder that constitute the bearing need to be disposed close to each other. However, if the temperature of the rotary cylinder becomes high due to a raised temperature of the target, the rotary cylinder thermally expands and the gap of the hydrodynamic bearing, that is, the gap of the stationary shaft and the rotary cylinder is enlarged. As a result, if the temperature of the rotary cylinder becomes high, a load carrying capacity of the bearing is lowered and a normal rotational motion is disabled. Accordingly, a widely-known configuration includes, in some places of the stationary shaft and the rotary cylinder constituting the bearing, stationary shaft and the rotary cylinder that are provided close to each other and a heat-transfer unit that is configured by filling the liquid metal between the stationary shaft and the rotary cylinder is provided; and, in places other than the bearing, the gap of the stationary shaft and the rotary cylinder that is enlarged. According to this configuration, the heat transfer to the hydrodynamic bearing is prevented and the heat of the target is transmitted to a cooling fluid in the stationary shaft through the liquid metal interposed in the heat-transfer unit provided separately from the hydrodynamic bearing. As such, since the heat transfer is mainly made in the heat-transfer unit, the gap of the hydrodynamic bearing is suppressed from being enlarged. Accordingly, the load carrying capacity of the hydrodynamic bearing can be suppressed from being lowered.

Meanwhile, in the CT apparatus where the X-ray tube apparatus is mounted, a helical scanning scheme that irradiates X-rays onto an inspected object, such as a person, while revolving the X-ray tube apparatus around the inspected object is adopted. The helical scanning speed, that is, the revolving speed of the X-ray tube apparatus has been increased. Due to the increase in the helical scanning speed, it is required to improve anti-G performance of the X-ray tube that is mounted in the X-ray tube apparatus. In this case, the improvement of the anti-G performance means that the stationary shaft is rarely bent and deformed even when the X-ray tube receives the centrifugal force due to the high-speed scanning. When the anti-G performance of the X-ray tube is low, if the stationary shaft supports the rotary anode where the centrifugal force is applied, the stationary shaft is bent and deformed. If the rotary anode and the stationary shaft that constitute the bearing are relatively greatly inclined due to the bending deformation of the stationary shaft, the rotary anode and the stationary shaft contact at an end of the bearing and superior rotation stability can not be obtained. Accordingly, if the anti-G performance is improved, the rotary anode and the stationary shaft can be suppressed from contacting at the end of the bearing and superior rotation stability of the rotary anode can be keeped.

The improvement of the anti-G performance of the X-ray tube is achieved by improving the bending rigidity of the stationary shaft.

Meanwhile, the X-ray tube is also required to have a high output of the X-rays. However, amount of heat generated in the target increases with the high output. Accordingly, due to the high output, a function of cooling the target with high heat transfer efficiency is needed. In the conventional X-ray tube, the wall thickness of the entire stationary shaft may be thinned to improve the heat transfer efficiency. However, if the wall thickness of the stationary shaft is decreased, sufficient anti-G performance is not obtained due to lowered rigidity of the stationary shaft.

That is, in the conventional X-ray tube, it is difficult to simultaneously realize the improvement of the anti-G performance and the high output.

In the conventional X-ray tube where the heat-transfer unit is separately provided, the liquid metal is interposed in the heat-transfer unit in addition to the bearing. For this reason, an area where viscosity friction of the liquid metal is generated increases, leading to increased frictional loss. Accordingly, in order to compensate for the frictional loss and rotate the anode at a high speed, rotation torque of the motor needs to be increased. Since the rotation toque of the motor is determined by strength of the magnetic field generated by the stator coil, the size of the stator coil needs to be increased to generate the stronger magnetic field. Since the size of the X-ray tube apparatus including the X-ray tube increases due to the increase in the size of the stator coil, the weight of the X-ray tube apparatus greatly increases. As the helical scanning speed of the CT apparatus increases, it is required to decrease the weight of apparatuses mounted on mount of the CT apparatus, and it is increasingly required to decrease the size and the weight of the X-ray tube apparatus. Accordingly, the increase in the size and the weight of the X-ray tube apparatus becomes a problem.

A total amount of heat generation of a rotating mechanism increases due to the frictional heat of the liquid metal interposed in the heat-transfer unit. Accordingly, it is required to decrease the demand output of the X-rays or further include a cooling mechanism that works by thinning the wall thickness of the heat transmitting part. That is, it is further difficult to simultaneously realize the improvement of the anti-G performance and the high output.

In the heat-transfer unit that does not have a groove to draw the lubricant in the bearing and keep the lubricant, like the hydrodynamic bearing, the liquid metal serving as a heat-transfer material may not exist in an assumed heat transfer area. Accordingly, cooling performance may not be constant and reliability of the cooling performance is low.

As described above, in the conventional X-ray tube, it is difficult to simultaneously realize the improvement of the anti-G performance and the high output. In the conventional X-ray tube where the heat-transfer unit is provided separately from the hydrodynamic bearing, the size of the X-ray tube apparatus including the X-ray tube increases and the weight increases.

DETAILED DESCRIPTION

A rotary anode X-ray tube according to an embodiment includes a stationary shaft, a cooling bath that is provided in the stationary shaft, a rotary cylinder that is rotatably supported to the stationary shaft, a target that is provided in the rotary cylinder, a cathode that is disposed to face the target, and a vacuum enclosure that stores these components.

The stationary shaft has a large-diameter portion provided in a portion thereof and is provided with a flow passage through which a cooling fluid flows. The cooling bath is provided by thinning the wall thickness of the large-diameter portion to increase the flow passage diameter of a portion of the flow passage. The rotary cylinder covers an area of the stationary shaft including the large-diameter portion through a liquid metal, and is rotatably supported to the stationary shaft. The target has a hollow circular plate shape that is provided on an outer circumferential surface of the rotary cylinder. The vacuum enclosure stores the stationary shaft, the rotary cylinder, the target, and the cathode and supports the stationary shaft.

Hereinafter, exemplary embodiments of the rotary anode X-ray tube apparatus will be described in detail with reference to the accompanying drawings.

First Embodiment

Figure 1:
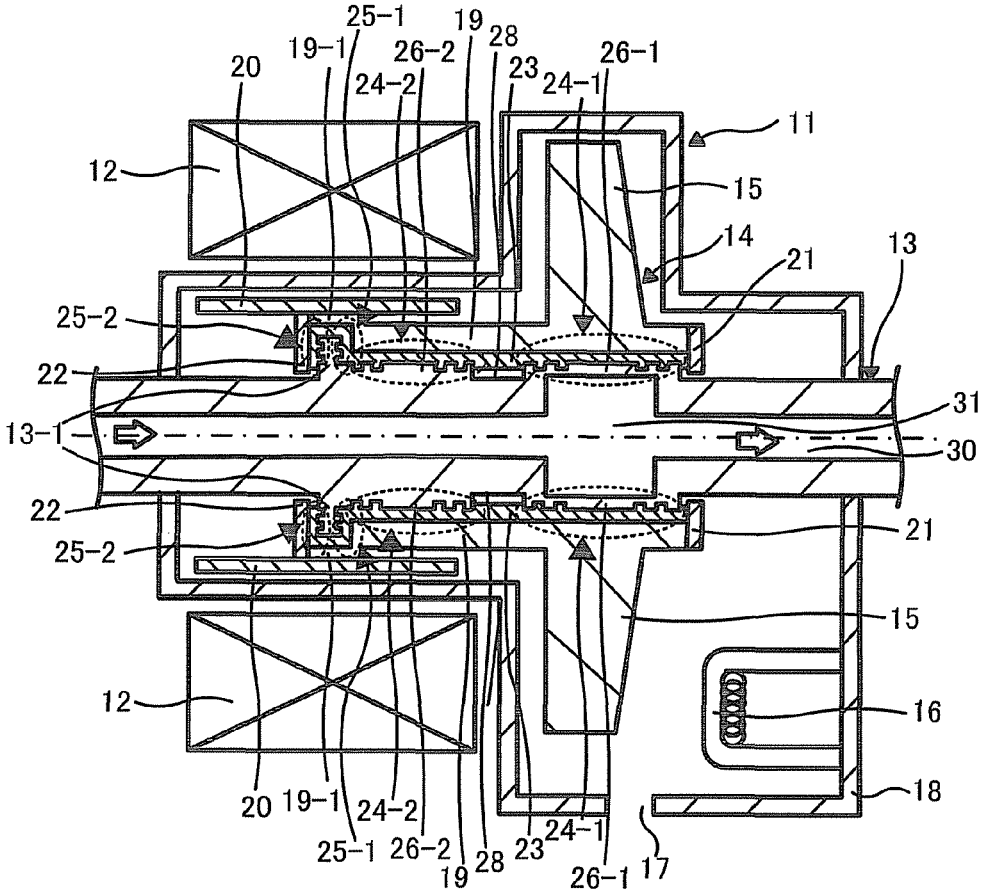
FIG. 1 is a cross-sectional view illustrating a rotary anode X-ray tube apparatus including a rotary anode X-ray tube according to a first embodiment along a stationary shaft, which illustrates when a rotary anode rotates.

FIG. 1 is a cross-sectional view illustrating a rotary anode X-ray tube apparatus including a rotary anode X-ray tube 11 according to a first embodiment along a stationary shaft 13 to be described below, which illustrates when a rotary anode 14 to be described below rotates. The rotary anode X-ray tube apparatus (hereinafter, simply referred to as X-ray tube apparatus) illustrated in FIG. 1 includes a rotary anode X-ray tube 11 (hereinafter, simply referred to as X-ray tube 11) that radiates X-rays, a stator coil 12, and a casing (not illustrated) that stores the X-ray tube 11 and the stator coil 12.

The X-ray tube 11 includes a stationary shaft 13, a rotary anode 14 that is rotatably provided in the stationary shaft 13, a cathode 16 that is disposed to face a target 15 included in the rotary anode 14, and a vacuum enclosure 18 that stores these components and has a transmissive window 17 provided in a portion thereof. The X-ray tube 11 has a so-called both-end supported structure where the stationary shaft 13 is supported to both facing sides of the vacuum enclosure 18. The cathode 16 is formed on one side of the vacuum enclosure 18.

The stationary shaft 13 has a cylindrical shape in which a flow passage 30 that causes a cooling fluid to flow into any side along an axial direction is provided. The stationary shaft 13 has a first large-diameter portion 26-1 and a second large-diameter portion 26-2 that is provided at a position apart from the first large-diameter portion 26-1. The first large-diameter portion 26-1 and the second large-diameter portion 26-2 are provided to have the diameters larger than the outer diameter of the stationary shaft 13 other than the first large-diameter portion 26-1 and the second large-diameter portion 26-2. On an outer circumferential surface of the second large-diameter portion 26-2, a flange portion 13-1 is provided.

The flow passage 30 that is provided in the stationary shaft 13 has a cooling bath 31 that is provided in a portion thereof. The cooling bath 31 is provided to have the flow passage diameter larger than the diameter of the flow passage 30 other than that of the cooling bath 31. That is, the cooling bath 31 is provided by thinning the wall thickness of the first large-diameter portion 26-1 to increase the flow passage diameter of a portion of the flow passage 30.

The rotary anode 14 includes a cylindrical rotary cylinder 19 that has almost the constant inner diameter, a target 15 (anode) having a hollow circular plate shape that is provided on an outer circumferential surface in the vicinity of one end of the rotary cylinder 19, a cylindrical motor rotor that is provided on an outer circumferential surface of the other end of the rotary cylinder 19, an annular seal 21 that closes one opening end of the rotary cylinder 19, and an annular thrust ring 22 that closes the other opening end of the rotary cylinder 19. Each of the seal 21 and the thrust ring 22 is provided to form a slight gap with the stationary shaft 13.

In the rotary cylinder 19, a flange portion 19-1 having a shape that corresponds to the shape of the flange portion 13-1 of the stationary shaft 13 is formed in the other end. That is, the motor rotor 20 is provided in the flange portion 19-1 of the rotary cylinder 19. The thrust ring 22 is provided to close the flange portion 19-1 of the rotary cylinder 19.

In this embodiment, the rotary cylinder 19 and the target 15 are integrated to easily transmit heat therebetween. However, the rotary cylinder 19 and the target 15 may be diffusively joined.

The rotary anode 14 that has the rotary cylinder 19 is provided to cover an area of the stationary shaft 13 including the first large-diameter portion 26-1 and the second large-diameter portion 26-2 with a gap between the stationary shaft 13 and the rotary anode 14. The rotary anode 14 is provided such that the target 15 is positioned in the vicinity of the first large-diameter portion 26-1 provided in the stationary shaft 13.

A liquid metal 23 is filled in the gap between the stationary shaft 13 and the rotary anode 14. The liquid metal 23 serves as a lubricant of a hydrodynamic bearing that supports the rotary anode 14, when the rotary anode 14 rotates about the stationary shaft 13. As the liquid metal 23, for example, a gallium alloy with gallium as a main component is mainly used.

When the rotary anode 14 is not rotating, the liquid metal 23 is kept downward and is mainly stored in a liquid metal storage unit 28 that is provided in a concave shape between the first large-diameter portion 26-1 and the second large-diameter portion 26-2 of the stationary shaft 13.

The hydrodynamic bearing that supports the rotary anode 14 includes first and second radial bearings 24-1 and 24-2 that support the rotary anode 14 in a radial direction and first and second thrust bearings 25-1 and 25-2 that support the rotary anode 14 in an axial direction.

The first radial bearing 24-1 is configured by the first large-diameter portion 26-1, a portion of the rotary cylinder 19 that faces the first large-diameter portion 26-1, and the liquid metal 23 that is interposed between the first large-diameter portion and the portion of the rotary cylinder 19. Likewise, the second radial bearing 24-2 is configured by the second large-diameter portion 26-2 except for the flange portion 13-1, a portion of the rotary cylinder 19 that faces the second large-diameter portion 26-2 except for the flange portion 13-1, and the liquid metal 23 that is interposed between these portions.

That is, the liquid metal 23 that is kept downward while the rotary anode 14 is stopped starts flowing along a rotation direction of the rotary anode 14, when the rotary anode 14 rotates. As such, when the rotary anode 14 rotates, the centrifugal force is generated in the liquid metal 23. By the centrifugal force, the liquid metal 23 is stuck to all circumferences of an inner surface of the rotary cylinder 19. The first and second radial bearings 24-1 and 24-2 support the rotary anode 14 in a radial direction using a hydrodynamic effect generated when the liquid metal 23 flows. In the first and second large-diameter portions 26-1 and 26-2, grooves that generate the hydrodynamic effect are provided. These grooves have the same effect, even when the grooves are provided in the portion of the rotary cylinder 19 constituting each of the first radial bearing 24-1 and the second radial bearing 24-2. Shapes and patterns of the grooves that generate the hydrodynamic effect will be described in detail below.

The first thrust bearing 25-1 is configured by one side of the flange portion 13-1 of the stationary shaft 13, a portion of the rotary cylinder 19 that faces the side of the flange portion 13-1, and the liquid metal 23 that is interposed between the one side and the portion. Likewise, the second thrust bearing 25-2 is configured by the other side of the flange portion 13-1 of the stationary shaft 13, the thrust ring 22 that faces the side of the flange portion 13-1, and the liquid metal 23 that is interposed between the other side and the thrust ring.

That is, when the rotary anode 14 rotates, the liquid metal 23 that constitutes each of the first and second thrust bearings 25-1 and 25-2 flows along the rotation direction of the rotary anode 14. The first and second thrust bearings 25-1 and 25-2 support the rotary anode 14 in the axial direction using the hydrodynamic effect generated when the liquid metal 23 flows. On both sides of the flange portion 13-1 of the stationary shaft 13, grooves that generate the hydrodynamic effect are provided. These grooves have the same effect, even when the grooves are provided in the portion of the rotary cylinder 19 constituting the first thrust bearing 25-1 and the thrust ring 22 constituting the second thrust bearing 25-2, respectively. Shapes and patterns of the grooves that generate the hydrodynamic effect will be described in detail below.

Figure 2:
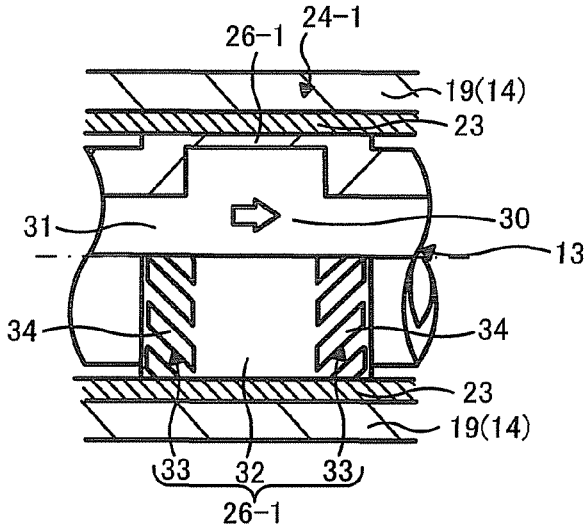
FIG. 2 is an enlarged half cross-sectional view of a radial bearing.

Next, the grooves that are provided in both sides of the flange portion 13-1 of the stationary shaft 13 and the first and second large-diameter portions 26-1 and 26-2 constituting the hydrodynamic bearings 24-1, 24-2, 25-1, and 25-2 will be described. FIG. 2 is an enlarged half cross-sectional view of the first radial bearing 24-1. As illustrated in FIG. 2, the first large-diameter portion 26-1 includes a plane region 32 that is not provided with a groove and a pair of groove portions 33 that are provided in both sides of the plane region 32. In the pair of groove portions 33, plural grooves 34 having a truncated chevron shape are provided in a form of patterns of a constant interval on an outer circumferential surface of the first large-diameter portion 26-1 of the stationary shaft 13. That is, each of the plural grooves 34 has a groove shape and a pattern to feed the liquid metal 23 to the plane region 32, when the rotary anode 14 rotates.

If the plural grooves 34 illustrated in FIG. 2 are provided, the liquid metal 23 is fed to the plane region 32 by the plural grooves 34, when the rotary anode 14 rotates. Thereby, the liquid metal 23 can be securely interposed between the first large-diameter portion 26-1 and the rotary cylinder 19. Accordingly, in the first radial bearing 24-1, the hydrodynamic effect is securely generated. In the plane region 32, the rotary anode 14 becomes eccentric with respect to the stationary shaft 13 by the centrifugal force, a fluid lubrication film is formed by a wedge effect generated when a gap of the rotary cylinder 19 and the plane region 32 is narrowed, and the pressure is generated in a direction where the gap of the rotary cylinder 19 and the plane region is enlarged. That is, the rotary anode 14 is stably and rotatably supported by the pressure based on the hydrodynamic effect and the pressure based on the wedge effect.

Similar to the groove shape and the pattern that are provided in the first large-diameter portion 26-1 illustrated in FIG. 2, a groove shape and a pattern are also provided in the second large-diameter portion 26-2. Accordingly, even in the second radial bearing 24-2, the hydrodynamic effect is securely generated.

The support of the rotary anode 14 is particularly effective in the case where the strong centrifugal force is applied to the rotary anode 14, like the X-ray tube 11 that is mounted in the helical scanning CT apparatus.

Figure 3:
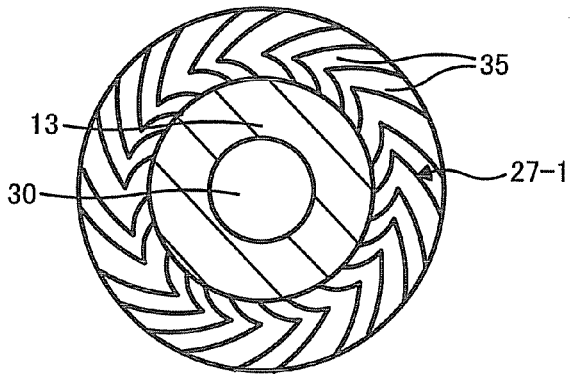
FIG. 3 is a cross-sectional view of one side of a flange portion of the stationary shaft illustrated in FIG. 1, when viewed from an axial direction of the stationary shaft.

FIG. 3 is a cross-sectional view of one side of the flange portion 13-1 of the stationary shaft 13, when viewed from the axial direction of the stationary shaft 13. As illustrated in FIG. 3, in one side of the flange portion 13-1 of the stationary shaft 13, plural grooves 35 having a V shape are provided in a form of patterns of a constant interval along the rotation direction of the rotary anode 14 (not illustrated in FIG. 3). That is, the plural grooves 35 having a V shape are provided to feed the liquid metal 23 (not illustrated in FIG. 3) between the flange portion 13-1 of the stationary shaft 13 and the rotary cylinder 19 (not illustrated in FIG. 3), when the rotary anode 14 (not illustrated in FIG. 3) rotates.

Referring back to FIG. 1, if the groove shape and the pattern illustrated in FIG. 3 are provided, when the rotary anode 14 rotates, the liquid metal 23 is fed between one side of the flange portion 13-1 of the stationary shaft 13 and the rotary cylinder by the plural grooves 35 having a V shape illustrated in FIG. 3. Thereby, the liquid metal 23 can be securely interposed between the flange portion 13-1 of the stationary shaft 13 and the rotary cylinder 19. Accordingly, even in the first thrust bearing 25-1, the hydrodynamic effect is securely generated. Even in the other side of the flange portion 13-1 of the stationary shaft 13, the groove shape and the pattern are provided in the same way as the above case. Accordingly, even in the second thrust bearing 25-2, the hydrodynamic effect is securely generated. The first thrust bearing 25-1 generates the hydrodynamic effect along the axial direction of the stationary shaft 13 in a direction toward the target 15. The second thrust bearing 25-2 generates the hydrodynamic effect along the axial direction of the stationary shaft 13 in a direction opposite to the direction toward the target 15. The first and second thrust bearings 25-1 and 25-2 support the rotary anode 14 from both sides in the axial direction, when the first and second thrust bearings 25-1 and 25-2 generate the same hydrodynamic effects.

The first and second radial bearings 24-1 and 24-2 and the first and second thrust bearings 25-1 and 25-2 have been described. As illustrated in FIG. 1, the first radial bearing 24-1 is positioned between the target 15 with high temperature and the cooling fluid with low temperature in the cooling bath 31. Accordingly, a temperature gradient is generated in the first radial bearing 24-1 and the temperature gradient may be larger than a desired temperature gradient. In such a case, the temperature of the rotary cylinder 19 corresponding to the rotation side becomes higher than the temperature of the stationary shaft 13 corresponding to the fixed side. As a result, the thermally expanded amount of the rotary cylinder 19 becomes larger than the thermally expanded amount of the stationary shaft 13 and the gap of the first radial bearing 24-1 is enlarged. In this case, the load carrying capacity of the hydrodynamic bearing in the first radial bearing 24-1 is lowered and a superior rotation operation of the rotary anode 14 is disabled. As such, when the temperature gradient generated in the first radial bearing 24-1 becomes larger than the desired temperature gradient, if a material that has a smaller linear expansion coefficient than a material of the stationary shaft 13 is selected as a material of the rotary cylinder 19, the gap of the first radial bearing 24-1 is suppressed from being enlarged. For example, if molybdenum or a molybdenum alloy is used as the material of the rotary cylinder 19, and a ferrous metal material having iron as its main component, such as iron, steel, an iron-nickel alloy, an iron-chromium alloy or an iron-nickel-chromium alloy is used as the material of the stationary shaft 13, the gap of the first radial bearing 24-1 is suppressed from being enlarged.

In the X-ray tube apparatus described above, a magnetic field is generated in the motor rotor 20 by the stator coil 12, thereby rotating the rotary anode 14. At this time, electron beams are irradiated from the cathode 16 to the target 15. Thereby, if electrons collide with the target 15, X-rays are discharged from a transmissive window 17 provided in the vacuum enclosure 18 to the outside. When it occurs, heat is generated in the target 15. This heat is transmitted from the target 15 to the rotary cylinder 19. In the first radial bearing 24-1, the wall thickness of the first large-diameter portion 26-1 that constitutes a portion of the first radial bearing 24-1 is thinned and heat transfer efficiency of the first radial bearing 24-1 is high. Thus, the first radial bearing 24-1 functions as a heat-transfer unit. Accordingly, the heat that is transmitted from the target 15 to the rotary cylinder 19 is transmitted to the cooling fluid in the cooling bath 31 through the first radial bearing 24-1, and is transferred to the outside of the X-ray tube 11 as the cooling fluid moves. In this way, the target 15 is cooled.

According to the X-ray tube 11 according to the first embodiment or the X-ray tube apparatus including the X-ray tube 11, the cooling bath 31 where the flow passage diameter in a portion of the flow passage is increased by thinning only the wall thickness of the first large-diameter portion 26-1 is formed in the stationary shaft 13. Accordingly, heat transfer efficiency can be improved without deteriorating bending rigidity of the stationary shaft 13. Thereby, the rotary anode X-ray tube 11 with high reliability where anti-G performance is superior and a high output is enabled can be provided. Thereby, even though the centrifugal force based on helical scanning of the CT apparatus is applied to the rotary anode 14, the hydrodynamic bearings 24-1, 24-2, 25-1, and 25-2 can keep superior rotation stability.

The heat of the rotary cylinder 19 is transmitted to the cooling bath 31 through the first radial bearing 24-1 that performs a function as the heat-transfer unit in addition to the bearing function. Accordingly, the heat-transfer units that transmit the heat do not need to be provided in the places other than the hydrodynamic bearings 24-1, 24-2, 25-1, and 25-2, different from the related art. As a result, a size of an area where viscosity friction of the liquid metal 23 is generated can be decreased as compared with the conventional X-ray tube having the heat-transfer unit. Thereby, since frictional loss generated by the liquid metal 23 is decreased, the frictional heat that is generated in the liquid metal 23 can be minimally suppressed. Further, a size of the stator coil 12 does not need to be increased to compensate for the frictional loss. Accordingly, a rotary anode X-ray tube apparatus that includes the X-ray tube 11, having superior anti-G performance and enabling a high output with the small size and the low weight, can be provided.

In addition to the above effect, in the X-ray tube 11 according to the first embodiment or the X-ray tube apparatus including the X-ray tube 11, as illustrated in FIG. 2, the plural grooves 34 through which the liquid metal 23 can be securely interposed in the gap of the first radial bearing 24-1 is formed in the first large-diameter portion 26-1 constituting the portion of the first radial bearing 24-1 functioning as the heat-transfer unit. Accordingly, reliability of the cooling performance of the rotary anode X-ray tube 11 and the rotary anode X-ray tube apparatus including the X-ray tube 11 can also be improved.

In the X-ray tube 11 according to the first embodiment or the X-ray tube apparatus including the X-ray tube 11, as illustrated in FIGS. 2 and 3, the plural grooves 34, 35 through which the liquid metal 23 can be securely interposed in the gaps of the other bearings 24-2, 25-1, and 25-2 are formed in the flange portion 13-1 of the stationary shaft 13 and the second large-diameter portion 26-2 constituting the portion of each of the other hydrodynamic bearings 24-2, 25-1, and 25-2. Accordingly, since the hydrodynamic effect can be securely generated in the individual bearings 24-1, 24-2, 25-1, and 25-2, reliability of the support of the rotary anode 14 can also be improved.

In the first and second large-diameter portions 26-1 and 26-2, as illustrated in FIG. 2, the plane region 32 and a pair of groove portions 33 that has the groove shape and the pattern to feed the liquid metal 23 to the plane region 32 are formed. Here, the rotary anode 14 is also supported by the fluid lubrication film formed in the plane region 32. By the plane region 32 where there is no unevenness, the heat transfer efficiency is improved. Accordingly, reliability of the support of the rotary anode 14 can be further improved, as well as a higher output of the X-ray tube 11 or the X-ray tube apparatus including the X-ray tube 11 can be obtained.

Second Embodiment

Figure 4:
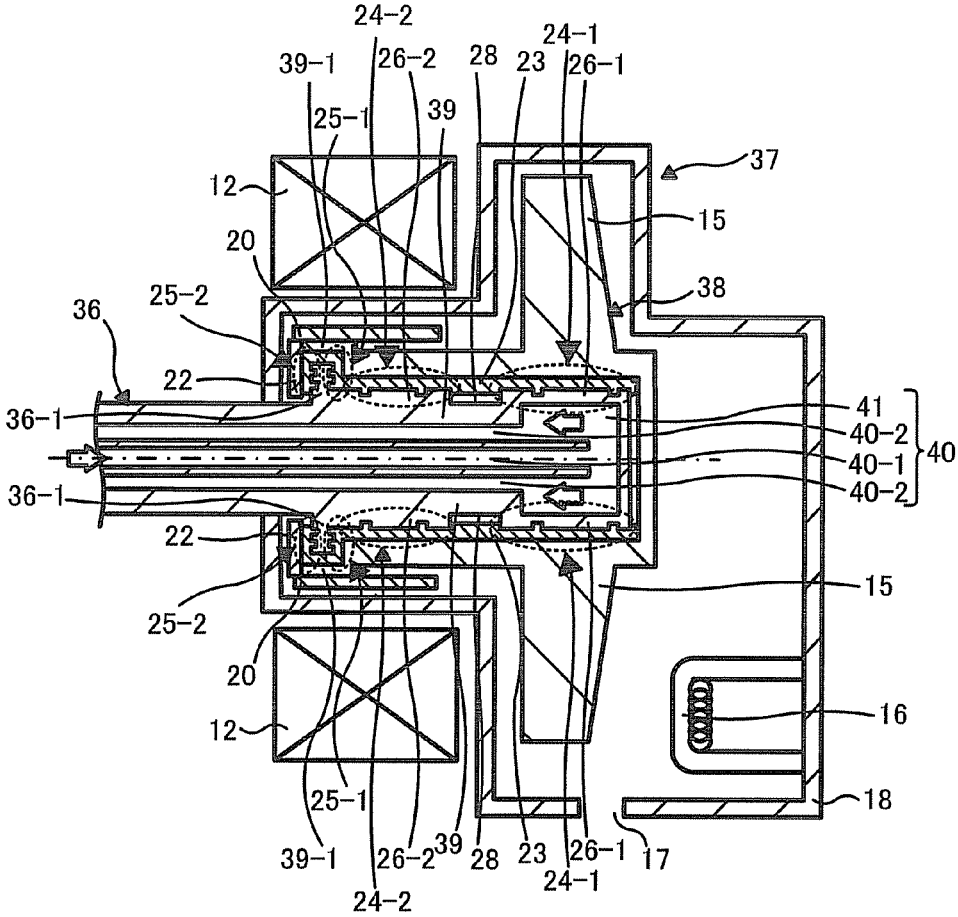
FIG. 4 is a cross-sectional view illustrating a rotary anode X-ray tube apparatus including a rotary anode X-ray tube according to a second embodiment, similar to FIG. 1, which illustrates when a rotary anode rotates.

FIG. 4 is a cross-sectional view illustrating a rotary anode X-ray tube apparatus including a rotary anode X-ray tube 37 according to a second embodiment along a stationary shaft 36, which illustrates when a rotary anode 38 rotates. In the description of the X-ray tube apparatus, only portions that are different from those of the X-ray tube apparatus illustrated in FIG. 1 will be described.

The X-ray tube apparatus illustrated in FIG. 4 is different from the X-ray tube apparatus illustrated in FIG. 1 in that the X-ray tube apparatus illustrated in FIG. 4 has an X-ray tube 37 with a so-called cantilevered structure where the stationary shaft 36 is supported to one side of the vacuum enclosure 18. That is, in the X-ray tube 37 according to the second embodiment, one end of the stationary shaft 36 is positioned in the vacuum enclosure 18.

In the X-ray tube 37 according to the second embodiment, the stationary shaft 36 has a cylindrical shape having a bottom that is provided with a flow passage 40 therein to circulate a cooling fluid along an axial direction thereof. The stationary shaft 36 has a first large-diameter portion 26-1 and a second large-diameter portion 26-2. The first large-diameter portion 26-1 and the second large-diameter portion 26-2 are provided to have the diameters larger than the outer diameter of the stationary shaft 36 other than the first large-diameter portion 26-1 and the second large-diameter portion 26-2.

The first large-diameter portion 26-1 is provided on one end of the stationary shaft 36 positioned in the vacuum enclosure 18. The second large-diameter portion 26-2 is provided at a position apart from the first large-diameter portion 26-1. On an outer circumferential surface of the second large-diameter portion 26-2, a flange portion 36-1 is provided.

The flow passage 40 that is provided in the stationary shaft 36 has a cooling bath 41 that is provided in a portion thereof. The cooling bath 41 is provided to have the flow passage diameter larger than the diameter of the flow passage 40 other than that of the cooling bath 41. That is, the cooling bath 41 is provided by thinning the wall thickness of the first large-diameter portion 26-1 to increase the flow passage diameter.

The flow passage 40 has an inflow passage 40-1 that causes the cooling fluid to flow to one end of the stationary shaft 36 and an outflow passage 40-2 that is formed to cover circumference of the inflow passage 40-1 and causes the cooling fluid to flow from one end of the stationary shaft 36 to the outside. The inflow passage 40-1 and the outflow passage 40-2 are joined to the cooling bath 41 provided on one end of the stationary shaft 36.

The rotary anode 38 has a rotary cylinder 39 in a cylindrical shape having a bottom that has a flange portion 39-1 in a shape corresponding to the shape of the flange portion 36-1 of the stationary shaft 36, and has almost the constant inner diameter in portions other than the flange portion 36-1; a target 15 (anode) having a hollow circular plate shape that is provided in the vicinity of the bottom of the rotary cylinder 39; a cylindrical motor rotor 20 that is provided in the flange portion 39-1 of the rotary anode 38; and an annular thrust ring 22 that closes the flange portion 39-1 of the rotary cylinder 39. The thrust ring 22 is provided to have a slight gap between the stationary shaft 36 and the thrust ring 22.

The rotary cylinder 39 is provided to cover an area of the stationary shaft 36 including the first large-diameter portion 26-1 and the second large-diameter portion 26-2 with a gap between the stationary shaft 36 and the rotary cylinder 39. In the rotary anode 38 that has the rotary cylinder 39, the target 15 is provided to be positioned in the vicinity of the first large-diameter portion 26-1.

A supporting mechanism of the rotary anode 38 is the same as that of the first embodiment. That is, the rotary anode 38 is rotatably supported by the hydrodynamic bearings 24-1, 24-2, 25-1, and 25-2 that are configured in the same way as the first embodiment.

Even in the X-ray tube 37 according to the second embodiment or the X-ray tube apparatus including the X-ray tube 37, the same effect as that of the first embodiment can be obtained. That is, the rotary anode X-ray tube 37 that has superior anti-G performance and enables a high output can be provided. Further, a rotary anode X-ray tube apparatus that includes the X-ray tube 37, having superior anti-G performance and enabling a high output with the small size and the low weight, can be provided. Still further, reliability of the cooling performance of the X-ray tube 37 or the X-ray tube apparatus including the X-ray tube 37 can be improved. In addition, reliability of the support of the rotary anode 38 can also be improved.

Since the X-ray tube 37 according to the second embodiment has the cantilevered structure in which the stationary shaft 36 is supported to one side of the vacuum enclosure 18, the anti-G performance is deteriorated as compared with the X-ray tube 11 having the both-end supported structure in the first embodiment. However, if the X-ray tube 37 having the cantilevered structure is applied to the X-ray tube apparatus when the centrifugal force applied to the rotary anode 38 is weak, a rotary anode X-ray tube apparatus with high reliability that has superior anti-G performance and enables a high output with the small size and the low weight can be provided.

In X-ray tube according to the following embodiments, since the configurations (the vacuum enclosure 18, and the cathode 16) other than a stationary shaft and a rotary anode of each X-ray tube is the same as that of the X-ray tube 11 illustrated in FIG. 1, the neither description of the same configuration will not be provided herein.

Third Embodiment

Figure 5:
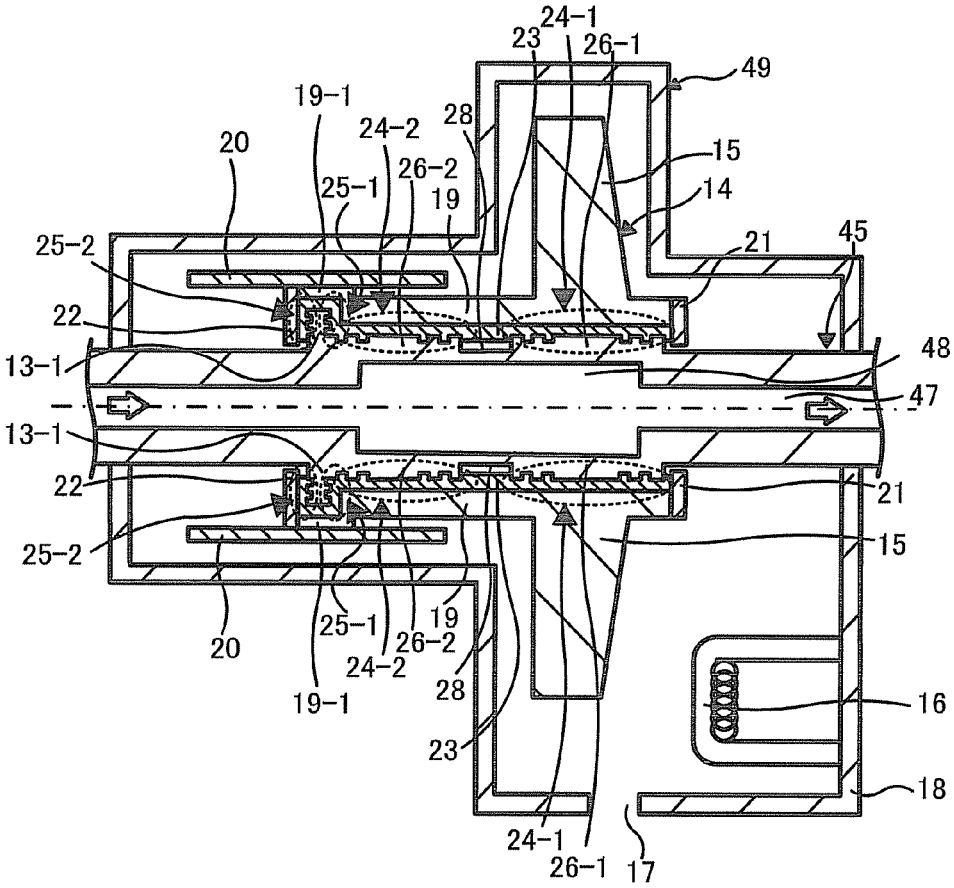
FIG. 5 is a cross-sectional view illustrating a rotary anode X-ray tube according to a third embodiment along a stationary shaft, which illustrates when a rotary anode rotates.

FIG. 5 is a cross-sectional view illustrating a rotary anode X-ray tube 49 according to a third embodiment along a stationary shaft 45, which illustrates when the rotary anode 14 rotates. As illustrated in FIG. 5, the X-ray tube 49 according to the third embodiment is the same as the X-ray 11 according to the first embodiment in that a flow passage 47 provided in the stationary shaft 45 has a cooling bath 48, but is different from the X-ray tube 11 according to the first embodiment in that the cooling bath 48 is provided by thinning the wall thickness of the first large-diameter portion 26-1, the second large-diameter portion 26-2, and the stationary shaft 45 between the first and second large-diameter portions 26-1 and 26-2 to uniformly. That is, the third embodiment is different from the first embodiment in that the length of the cooling bath 48 in the axial direction of the stationary shaft 45 is increased.

The supporting mechanism of the rotary anode 14 is the same as that of the first embodiment. That is, the rotary anode 14 is rotatably supported by the hydrodynamic bearings 24-1, 24-2, 25-1, and 25-2 configured in the same way as the first embodiment.

Even in the X-ray tube 49 according to the third embodiment or the X-ray tube apparatus including the X-ray tube 49, the rotary anode X-ray tube 49 that has superior anti-G performance and enables a high output can be provided, similar to the first embodiment. Further, a rotary anode X-ray tube apparatus that includes the X-ray tube 49, having superior anti-G performance and enabling a high output with the small size and the low weight, can be provided. Still further, reliability of the cooling performance of the X-ray tube 49 or the X-ray tube apparatus including the X-ray tube 49 can be improved. In addition, reliability of the support of the rotary anode 14 can also be improved.

According to the X-ray tube 49 according to the third embodiment or the X-ray tube apparatus including the X-ray tube 49, the cooling bath 48 is enlarged in the axial direction of the stationary shaft 45, as compared with the first embodiment. As a result, an area of places where the heat of the rotary cylinder 19 can be transmitted to the cooling bath 48 expands. Thereby, as compared with the X-ray tube 11 according to the first embodiment or the X-ray tube apparatus including the X-ray tube 11, heat transfer efficiency can be improved. Accordingly, the rotary anode X-ray tube 49 or the rotary anode X-ray tube apparatus including the X-ray tube 49 that enables a higher output can be provided.

In addition, according to the X-ray tube 49 according to the third embodiment or the X-ray tube apparatus including the X-ray tube 49, since the cooling bath 48 is provided to be enlarged in the axial direction of the stationary shaft 45, the cooling fluid can smoothly flow. Thereby, heat transfer efficiency can be further improved. Accordingly, the rotary anode X-ray tube 49 or the rotary anode X-ray tube apparatus including the X-ray tube 49 that enables a higher output can be provided.

This structure is particularly effective in the case where amount of heat generation of the second radial bearing 24-2 increases due to the high-speed rotation of the rotary anode 19 in addition to the heat which transfers from the target 15.

Fourth Embodiment

Figure 6:
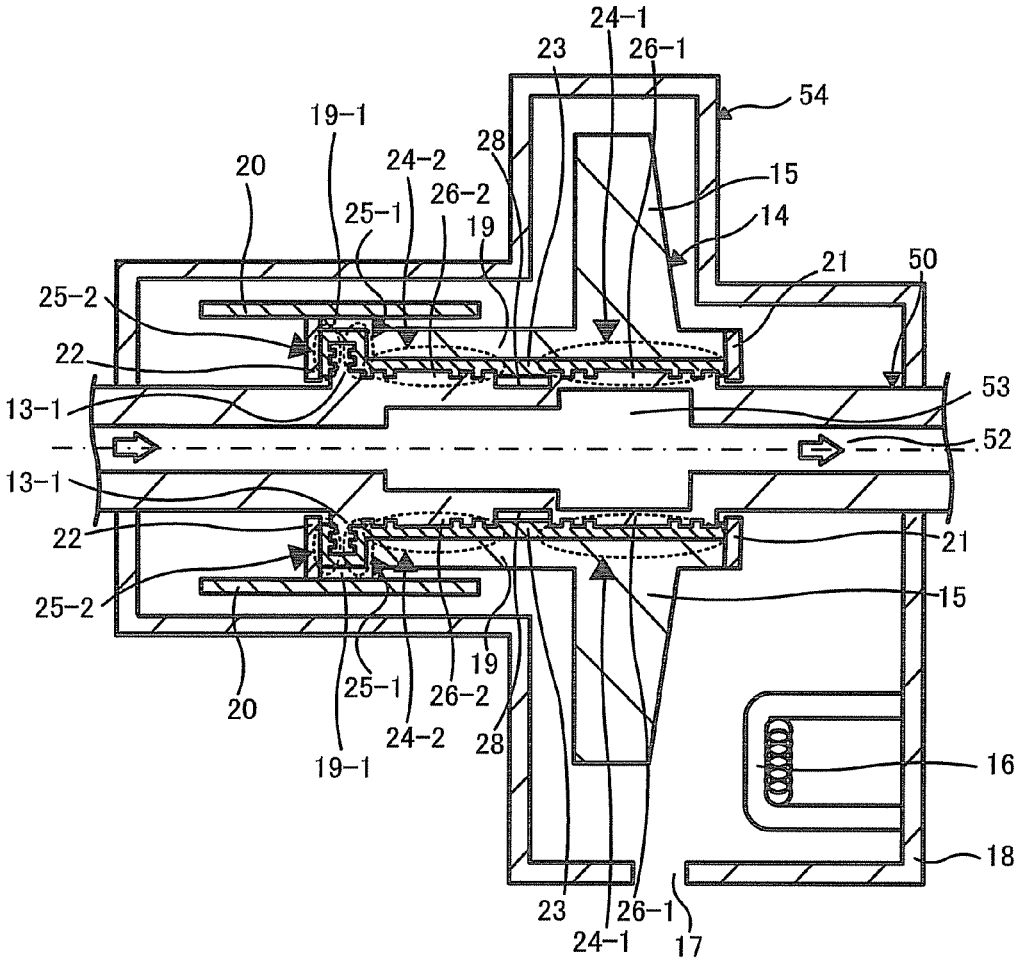
FIG. 6 is a cross-sectional view illustrating a rotary anode X-ray tube according to a fourth embodiment, similar to FIG. 5, which illustrates when a rotary anode rotates.

FIG. 6 is a cross-sectional view illustrating a rotary anode X-ray tube 54 according to a fourth embodiment along a stationary shaft 50, which illustrates when the rotary anode 14 rotates. As illustrated in FIG. 6, the X-ray tube 54 according to the fourth embodiment is the same as the X-ray tube 11 according to the first embodiment in that a flow passage 52 provided in the stationary shaft 50 has a cooling bath 53. However, it is different from the X-ray tube 11 according to the first embodiment in that the cooling bath 53 is provided by thinning the wall thickness of the first large-diameter portion 26-1, the second large-diameter portion 26-2, and the stationary shaft 50 between the first and second large-diameter portions 26-1 and 26-2 in a staircase pattern as they come close to the target 15. That is, the cooling bath 53 is provided by thinning the wall thickness of the first large-diameter portion 26-1 more than the wall thickness of the second large-diameter portion 26-2 to increase the flow passage diameter in a staircase pattern as the flow passage comes closer to the target 15.

The supporting mechanism of the rotary anode 14 is the same as that of the first embodiment. That is, the rotary anode 14 is rotatably supported by the hydrodynamic bearings 24-1, 24-2, 25-1, and 25-2 configured in the same way as the first embodiment.

Even in the X-ray tube 54 according to the fourth embodiment or the X-ray tube apparatus including the X-ray tube 54, the rotary anode X-ray tube 54 that has superior anti-G performance and enables a high output can be provided, similar to the first embodiment. Further, a rotary anode X-ray tube apparatus that includes the X-ray tube 54, having superior anti-G performance and enabling a high output with the small size and the low weight, can be provided. Still further, reliability of the cooling performance of the X-ray tube 54 or the X-ray tube apparatus including the X-ray tube 54 can be improved. In addition, reliability of the support of the rotary anode 14 can also be improved.

Since the cooling bath 53 is provided to be enlarged in the axial direction of the stationary shaft 50, the rotary anode X-ray tube 54 or the rotary anode X-ray tube apparatus including the X-ray tube that enable a higher output can be provided, similar to the rotary anode X-ray tube 49 according to the third embodiment or the rotary anode X-ray tube apparatus including the rotary anode X-ray tube 49.

In addition, according to X-ray tube 54 according to the fourth embodiment or the rotary anode X-ray tube apparatus including the rotary anode X-ray tube 54, when the second large-diameter portion 26-2 is formed to have the large thickness, as compared with the X-ray tube 49 according to the third embodiment or the X-ray tube apparatus including the rotary anode X-ray tube 49, the rotary anode X-ray tube 54 or the rotary anode X-ray tube apparatus including the X-ray tube 54 that has superior anti-G performance can be provided.

In contrast, when the first large-diameter portion 26-1 is formed to have the small thickness, as compared with the X-ray tube 49 according to the third embodiment or the X-ray tube apparatus including the rotary anode X-ray tube 49, the cooling performance can be further improved. Therefore, the rotary anode X-ray tube 54 or the rotary anode X-ray tube apparatus including the X-ray tube 54 that enables a higher output can be provided.

This structure is particularly effective in the case where higher heat transfer efficiency is needed as the flow passage comes closer to the target 15, such as the case where a total sum of the amount of heat generated in the target 15 and the first radial bearing 24-1 is larger than the amount of heat generated in the second radial bearing 24-2.

Fifth Embodiment

Figure 7:
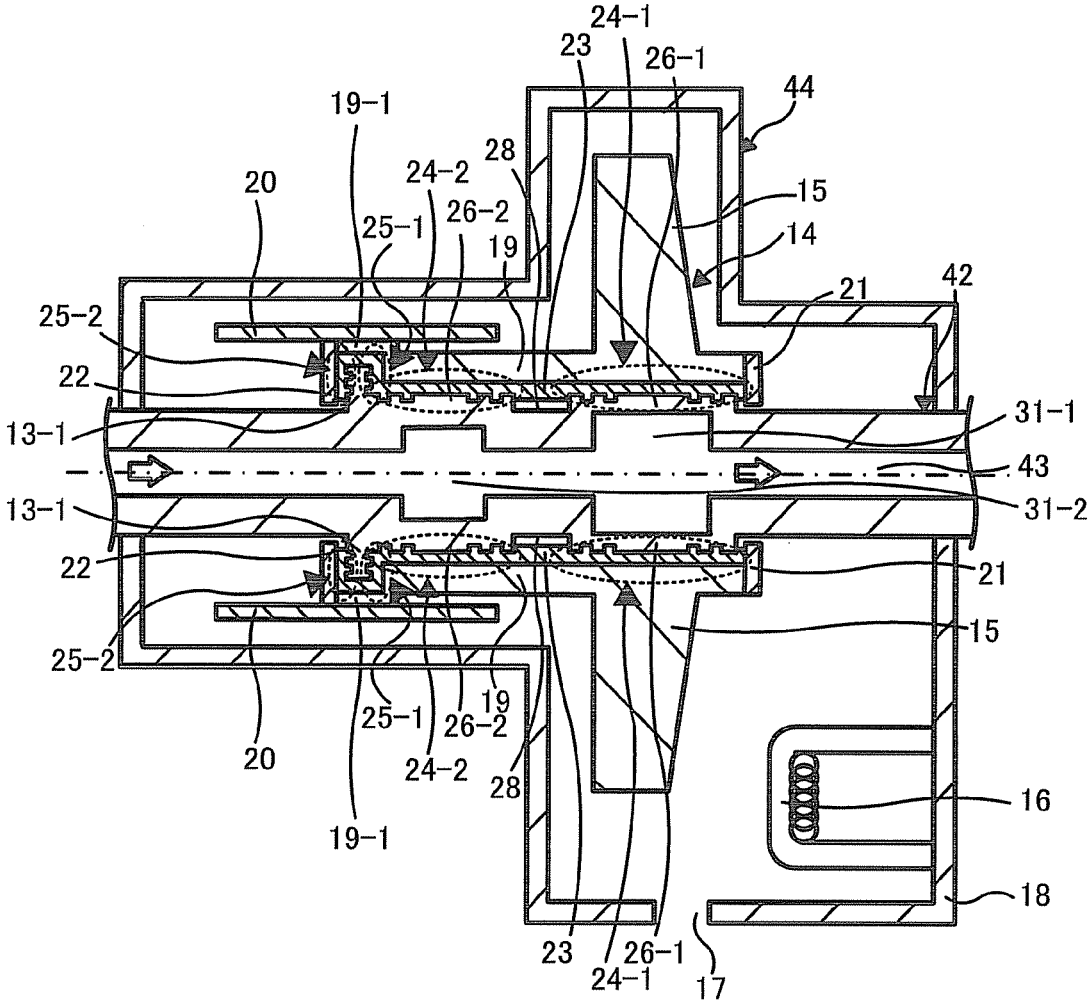
FIG. 7 is a cross-sectional view illustrating a rotary anode X-ray tube according a fifth embodiment, similar to FIG. 5, which illustrates when a rotary anode rotates.

FIG. 7 is a cross-sectional view illustrating a rotary anode X-ray tube 44 according to a fifth embodiment along a stationary shaft 42, which illustrates when the rotary anode 14 rotates. As illustrated in FIG. 7, the X-ray tube 44 according to the fifth embodiment is different from the X-ray tube 11 according to the first embodiment in that a flow passage 43 provided in the stationary shaft 42 has a first cooling bath 31-1 and a second cooling bath 31-2.

The first cooling bath 31-1 is provided such that the flow passage diameter is larger than the diameter of the flow passage 43 other than the first and second cooling baths 31-1 and 31-2, similar to the cooling bath 31 of the X-ray tube 11 according to the first embodiment illustrated in FIG. 1. That is, the first cooling bath 31-1 is provided by thinning the wall thickness of the first large-diameter portion 26-1 to increase the flow passage diameter.

Likewise, the second cooling bath 31-2 is provided at a position apart from the first cooling bath 31-1, such that the flow passage diameter is larger than the diameter of the flow passage 43 other than the first and second cooling baths 31-1 and 31-2. That is, the second cooling bath 31-2 is provided by thinning the wall thickness of the second large-diameter portion 26-2 to increase the flow passage diameter.

Specifically, the stationary shaft 42 has the configuration where the cooling bath 53 is divided into the first cooling bath 31-1 and the second cooling bath 31-2 by increasing the thickness of an intermediate portion of the cooling bath 53 illustrated in FIG. 6.

The first cooling bath 31-1 is provided by thinning the wall thickness of the first large-diameter portion 26-1 more than the wall thickness of the second large-diameter portion 26-2. Thereby, heat transfer efficiency of the first cooling bath 31-1 is improved more than heat transfer efficiency of the second cooling bath 31-2. This is because higher heat transfer efficiency is required as the flow passage comes closer to the target 15.

In the case of the above configuration, a direction where the cooling fluid flows through the stationary shaft 42 may be any direction. However, as illustrated by an arrow in FIG. 7, the cooling fluid preferably flows from the left side to the right side of the drawing, because the cooling fluid with high temperature in the first cooling bath 31-1 closer to the target 15 can be quickly discharged to the outside of the stationary shaft 42. This is also applicable to the above-described first, third, and fourth embodiments and sixth, seventh, and eighth embodiments to be described below.

The supporting mechanism of the rotary anode 14 is the same as that of the first embodiment. That is, the rotary anode 14 is rotatably supported by the hydrodynamic bearings 24-1, 24-2, 25-1, and 25-2 configured in the same way as the first embodiment.

Even in the X-ray tube 44 according to the fifth embodiment or the X-ray tube apparatus including the X-ray tube 44, the rotary anode X-ray tube 44 that has superior anti-G performance and enables a high output can be provided, similar to the first embodiment. Further, a rotary anode X-ray tube apparatus that includes the X-ray tube 44, having superior anti-G performance and enabling a high output with the small size and the low weight, can be provided. Still further, reliability of the cooling performance of the X-ray tube 44 or the X-ray tube apparatus including the X-ray tube 44 can be improved. In addition, reliability of the support of the rotary anode 14 can also be improved.

According to the X-ray tube 44 according to the fifth embodiment or the X-ray tube apparatus including the X-ray tube 44, since the wall thickness of the second large-diameter portion 26-2 is also formed to have the small thickness as compared with the X-ray tube 11 according to first embodiment, the heat of the rotary cylinder 19 can be transmitted to the second cooling bath 31-2 in addition to the first cooling bath 31-1. Thereby, as compared with the X-ray tube 11 according to the first embodiment or the X-ray tube apparatus including the X-ray tube 11, heat transfer efficiency can be improved. Accordingly, the rotary anode X-ray tube 44 or the rotary anode X-ray tube apparatus including the X-ray tube 44 that enables a higher output can be provided.

This structure is effective in the case where it is desired to improve anti-G performance while substantially keeping the cooling performance in the X-ray tube 49 and the X-ray tube 54 according to the third and fourth embodiments.

Sixth Embodiment

Figure 8:
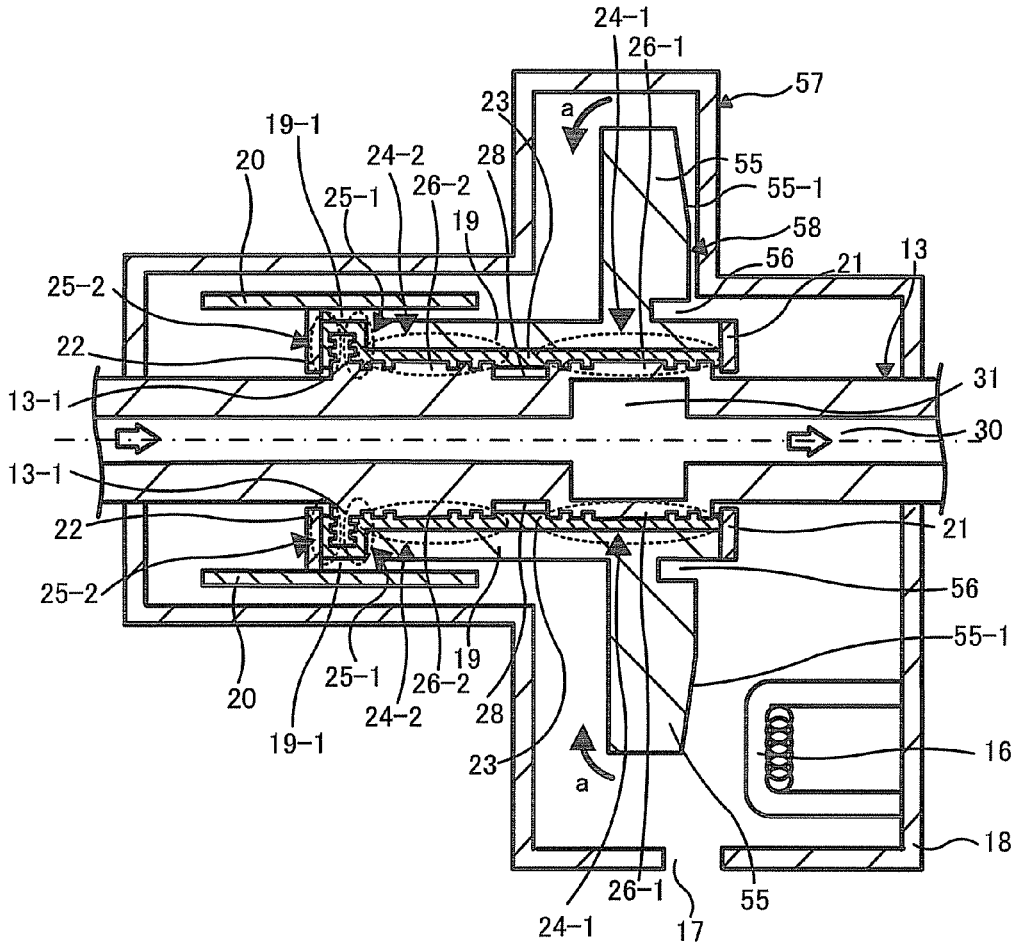
FIG. 8 is a cross-sectional view illustrating a rotary anode X-ray tube according to a sixth embodiment, similar to FIG. 5, which illustrates when a rotary anode rotates.

FIG. 8 is a cross-sectional view illustrating a rotary anode X-ray tube 57 according to a sixth embodiment along a stationary shaft 13, which illustrates when a rotary anode 58 rotates. As illustrated in FIG. 8, the X-ray tube 57 according to the sixth embodiment is different from the X-ray tube 11 according to the first embodiment in that a notch portion 56 having a circumferential shape along a circumferential direction of the stationary shaft 13 is provided at a position near the root of the target 55, that is, a position near the boundary of the target 55 and the rotary cylinder 19.

The notch portion 56 performs a function of suppressing the rotation cylinder 19 from deforming due to deformation caused by thermal expansion of the target 55. That is, in the target 55, since the temperature of an electron colliding surface 55-1 that electrons collide is locally raised due to electron collision, the electron colliding surface 55-1 is locally subjected to great thermal expansion. Thereby, the target 55 thermally deforms to be bent in a direction illustrated by an arrow a of FIG. 8. As such, if the target 55 thermally deforms, the rotation cylinder 19 also deforms if the notch portion 56 is not provided. However, since the target 55 has a flexible structure with respect to bending by providing the notch portion 56 in the target 55, the rotary cylinder 19 is suppressed from deforming due to the deformation caused by the thermal expansion of the target 55.

The supporting mechanism of the rotary anode 58 is the same as that of the first embodiment. That is, the rotary anode 58 is rotatably supported by the hydrodynamic bearings 24-1, 24-2, 25-1, and 25-2 configured in the same way as the first embodiment.

Even in the X-ray tube 57 according to the sixth embodiment or the X-ray tube apparatus including the X-ray tube 57, the rotary anode X-ray tube 57 that has superior anti-G performance and enables a high output can be provided, similar to the first embodiment. Further, a rotary anode X-ray tube apparatus that includes the X-ray tube 57, having superior anti-G performance and enabling a high output with the small size and the low weight, can be provided. Still further, reliability of the cooling performance of the X-ray tube 57 or the X-ray tube apparatus can be improved. In addition, reliability of the support of the rotary anode 58 can also be improved.

In the X-ray tube 57 according to the sixth embodiment or the rotary anode X-ray tube apparatus including the X-ray tube 57, since the notch portion 56 is provided in the target 55, the rotary cylinder is suppressed from deforming due to the deformation caused by the thermal expansion of the target 55. In contrast, as in the target 15 illustrated in FIG. 1, if the notch portion 56 is not provided, the rotary cylinder 19 also deforms due to the deformation of the target 15. In this case, since the gap of the first radial bearing 24-1 is enlarged and the load carrying capacity of the bearing is lowered, a superior rotation operation of the rotary anode 14 is inhibited. That is, if the notch portion 56 is provided in the target 55, the rotary cylinder is suppressed from deforming, and a superior rotation operation of the rotary anode 58 is keeped. Therefore, the rotary anode X-ray tube 57 or the rotary anode X-ray tube apparatus including the X-ray tube 57 that enables a higher output can be provided.

As described above, this structure is effective in the case where the rotary anode X-ray tube 57 or the rotary anode X-ray tube apparatus including the X-ray tube 57 needs to be configured to allow a higher output. That is, with the higher output, the temperature of the target 55 is raised to extraordinarily high temperature. In order to cool the target 55, the cooling bath 31 is provided in the stationary shaft 13 by thinning the wall thickness of the first large-diameter portion 26-1. However, the wall thickness of the first large-diameter portion 26-1 can be decreased only to a degree to which the anti-G performance of the stationary shaft 13 is keeped. Accordingly, the target 55 may not be sufficiently cooled. In this case, the deformation of the rotary cylinder 19 due to the deformation of the target 55 needs to be suppressed as the same time as cooling of the target 55 based on the first radial bearing 24-1. Thus, when it is desired to realize a higher output of the rotary anode X-ray tube 57 or the rotary anode X-ray tube apparatus including the X-ray tube 57 as well as keep anti-G performance, it is effective to provide the notch portion 56. If the position of the notch portion 56 is the position where the above effect can be obtained, the position is not limited to the position of the root of the target 55.

Seventh Embodiment

Figure 9:
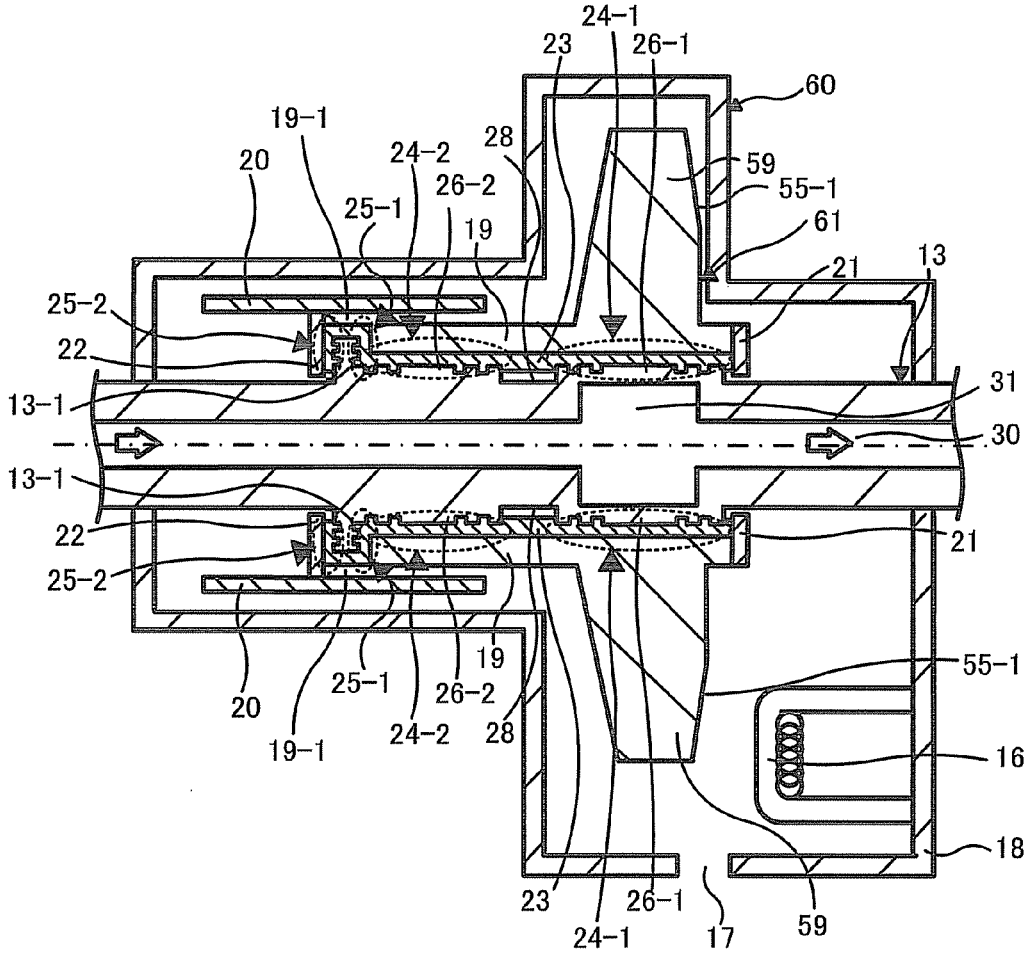
FIG. 9 is a cross-sectional view illustrating a rotary anode X-ray tube according to a seventh embodiment, similar to FIG. 5, which illustrates when a rotary anode rotates.

FIG. 9 is a cross-sectional view illustrating a rotary anode X-ray tube 60 according to a seventh embodiment along a stationary shaft 13, which illustrates when a rotary anode 61 rotates. As illustrated in FIG. 9, the X-ray tube 60 according to the seventh embodiment is different from the X-ray tube 11 according to the first embodiment in that an entire target 59 is formed to have the large thickness and the thickness further increases from an outer circumferential portion of the target 59 to the root portion with the rotary cylinder 19.

As such, even though the target 59 is formed to have the large thickness, the rotary cylinder 19 is suppressed from deforming due to the deformation caused by the thermal expansion of the target 59.

That is, if the target 59 is formed to have the large thickness, rigidity of the target 59 is enhanced. Accordingly, the rotary cylinder 19 is suppressed from deforming due to the deformation caused by the thermal expansion of the target 59.

The supporting mechanism of the rotary anode 61 is the same as that of the first embodiment. That is, the rotary anode 61 is rotatably supported by the hydrodynamic bearings 24-1, 24-2, 25-1, and 25-2 configured in the same way as the first embodiment.

Even in the X-ray tube 60 according to the seventh embodiment or the X-ray tube apparatus including the X-ray tube 60, the rotary anode X-ray tube 60 that has superior anti-G performance and enables a high output can be provided, similar to the first embodiment. Further, a rotary anode X-ray tube apparatus that includes the X-ray tube 60, having superior anti-G performance and enabling a high output with the small size and the low weight, can be provided. Still further, reliability of the cooling performance of the X-ray tube 60 or the X-ray tube apparatus including the X-ray tube 60 can be improved. In addition, reliability of the support of the rotary anode 61 can also be improved.

In the X-ray tube 60 according to the seventh embodiment or the X-ray tube apparatus including the X-ray tube 60, since the target 59 is formed to have the large thickness, the rotary cylinder 19 is suppressed from deforming due to the deformation caused by the thermal expansion of the target 59. Thereby, since a superior rotation operation of the rotary anode 61 is keeped, the rotary anode X-ray tube 60 or the rotary anode X-ray tube apparatus including the X-ray tube 60 that enables a higher output can be provided.

The seventh embodiment is the same as that sixth embodiment in that the above structure is effective in the case where it is desired to realize a higher output of the rotary anode X-ray tube 60 or the rotary anode X-ray tube apparatus as well as keep anti-G performance.

Eighth Embodiment

Figure 10:
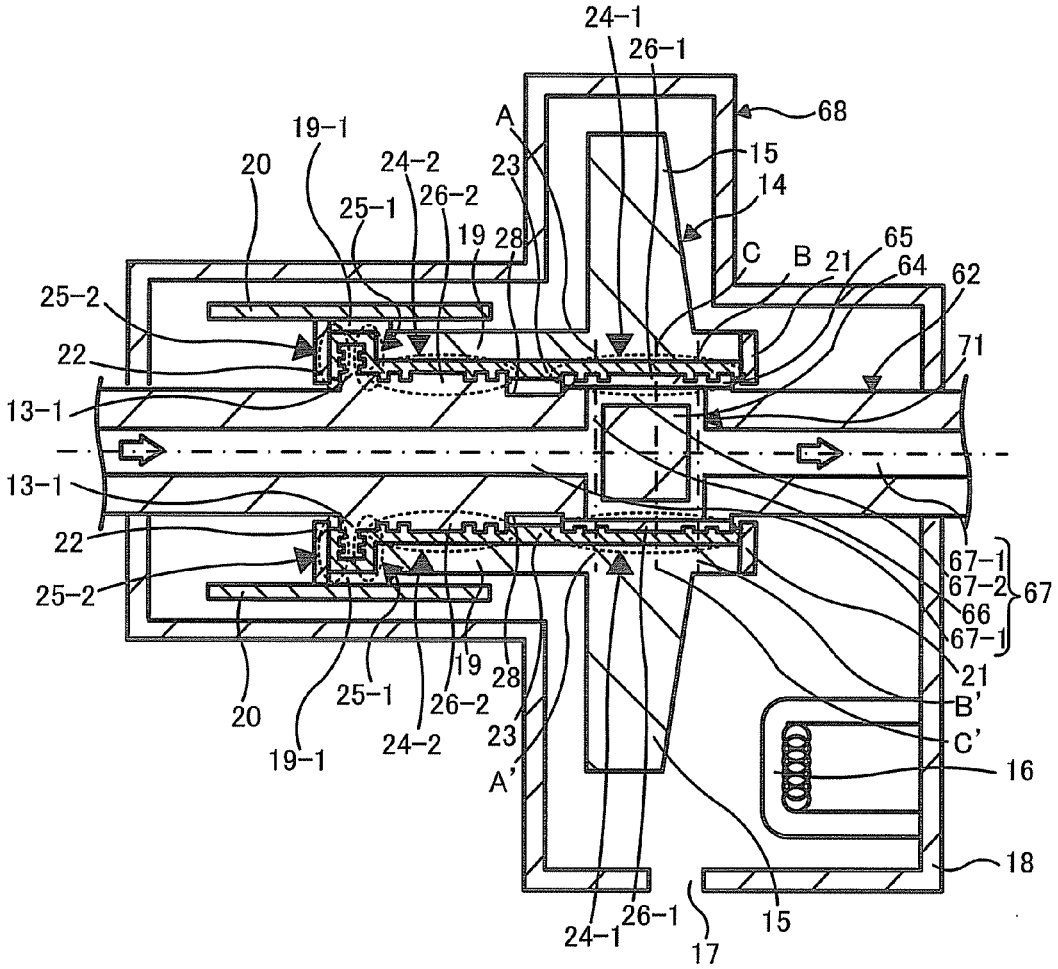
FIG. 10 is a cross-sectional view illustrating a rotary anode X-ray tube according to a eighth embodiment, similar to FIG. 5, which illustrates when a rotary anode rotates.

FIG. 10 is a cross-sectional view illustrating a rotary anode X-ray tube 68 according to an eighth embodiment along a stationary shaft 62, which illustrates when a rotary anode 14 rotates. As illustrated in FIG. 10, the X-ray tube 68 according to the eighth embodiment is different from the X-ray tube 11 according to the first embodiment in the structure of a cooling bath 71.

In the X-ray tube 68 according to the eighth embodiment, in the cooling bath 71, a columnar portion 64 that has an outer diameter smaller than that of the stationary shaft 62 is provided. The cooling bath 71 is formed by providing a cylindrical small-thickness portion 65, to have a constant gap between an outer circumferential surface of the columnar portion 64 and the cylindrical small-thickness portion 65. The small-thickness portion 65 becomes one element that constitutes the first radial bearing 24-1, and is provided such that the outer diameter of the small-thickness portion 65 is larger than the outer diameter of the stationary shaft 62, similar to the first large-diameter portion 26-1 that is provided in the X-ray tube 11 according to the first embodiment. Thereby, the first radial bearing 24-1 according to the eighth embodiment is configured by the small-thickness portion 65, a portion of the rotary cylinder 19 that faces the small-thickness portion 65, and the liquid metal 23 that is interposed between the small-thickness portion and the portion of the rotary cylinder 19.

Figure 11:
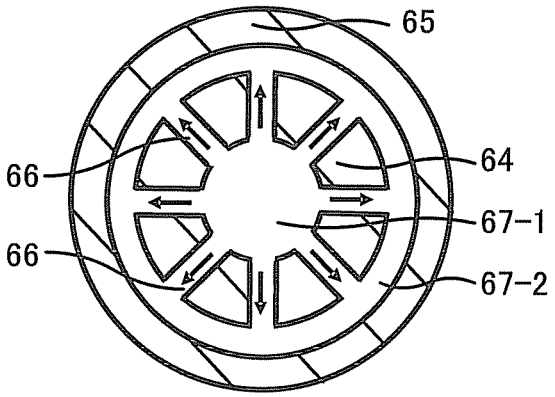
FIG. 11 is a cross-sectional view of the stationary shaft taken along a dashed-dotted line A-A' of FIG. 10.

The columnar portion 64 is formed in a portion of the stationary shaft 62, in a state where its central axis overlaps a central axis of the stationary shaft 62. In both end faces of the columnar portion 64 that is formed in the above way, radial holes 66 (described in detail below) illustrated in FIG. 11 are provided.

The small-thickness portion 65 is formed of components different from those of the stationary shaft 62. However, the small-thickness portion 65 may be formed of the same material as the formation material of the stationary shaft 62 or may be formed of a different material.

A flow passage 67 that includes the cooling bath 71 is configured by a first flow passage 67-1 other than the cooling bath 71, the radial holes 66 that are formed in both end faces of the columnar portion 64, and a second flow passage 67-2 that is a gap between the columnar portion 64 and the small-thickness portion 65. The first flow passage 67-1 and the second flow passage 67-2 are connected by the radial holes 66.

Figure 12:
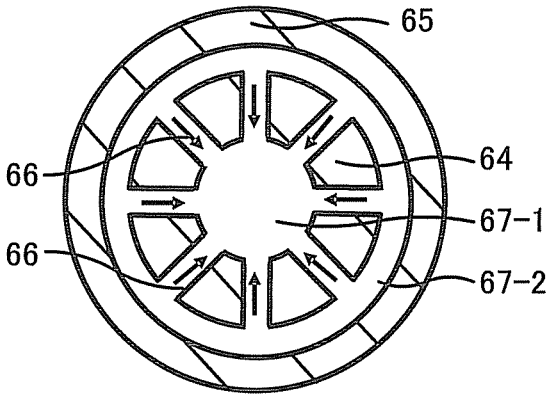
FIG. 12 is a cross-sectional view of the stationary shaft taken along a dashed-dotted line B-B' of FIG. 10.
Figure 13:
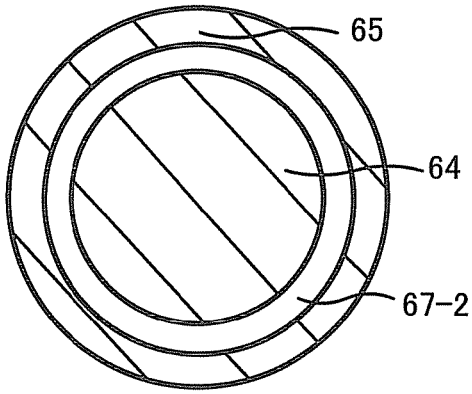
FIG. 13 is a cross-sectional view of the stationary shaft taken along a dashed-dotted line C-C' of FIG. 10.

Next, the flow passage 67 will be described in detail. FIG. 11 is a cross-sectional view of the stationary shaft 62 taken along a dashed-dotted line A-A' of FIG. 10, FIG. 12 is a cross-sectional view of the stationary shaft 62 taken along a dashed-dotted line B-B' of FIG. 10, and FIG. 13 is a cross-sectional view of the stationary shaft 62 taken along a dashed-dotted line C-C' of FIG. 10. As illustrated in FIGS. 11 and 12, the radial holes 66 that are provided in the columnar portion 64 are provided in a direction toward the outer circumferential portion from a central axis of the columnar portion 64. The radial holes 66 are configured such that a total sum of sectional areas of the radial holes 66 becomes equal to a sectional area of the first flow passage 67-1.

As illustrated in FIG. 13, the second flow passage 67-2 is configured such that a sectional area of the gap thereof becomes equal to the sectional area of the first flow passage 67-1.

That is, the flow passage 67 is provided such that its sectional area becomes always constant in an arbitrary section vertical to the axial direction of the stationary shaft 62.

The supporting mechanism of the rotary anode 14 is the same as that of the first embodiment. That is, the rotary anode 14 is rotatably supported by the hydrodynamic bearings 24-1, 24-2, 25-1, and 25-2 configured in the same way as the first embodiment.

Even in the X-ray tube 68 according to the eighth embodiment or the X-ray tube apparatus including the X-ray tube 68, the rotary anode X-ray tube 68 that has superior anti-G performance and enables a high output can be provided, similar to the first embodiment. Further, a rotary anode X-ray tube apparatus that includes the X-ray tube 68, having superior anti-G performance and enabling a high output with the small size and the low weight, can be provided. Still further, reliability of the cooling performance of the X-ray tube 68 or the X-ray tube apparatus including the X-ray tube 68 can be improved. In addition, reliability of the support of the rotary anode 14 can also be improved.

In the X-ray tube 68 according to the eighth embodiment or the X-ray tube apparatus including the X-ray tube 68, since the columnar portion 64 is provided in the cooling bath 71, the rotary anode X-ray tube 68 or the rotary anode X-ray tube apparatus including the X-ray tube 68 that has superior anti-G performance can be provided.

In addition, in the X-ray tube 68 according to the eighth embodiment or the X-ray tube apparatus including the X-ray tube 68, the flow passage 67 is provided such that its sectional area becomes always constant in the arbitrary section. Accordingly, the cooling fluid can be smoothly flown in and discharged, and the high-temperature cooling fluid can be suppressed from being stagnated in the cooling bath 71. As a result, heat transfer efficiency can be further improved and the rotary anode X-ray tube 68 or the rotary anode X-ray tube apparatus including the X-ray tube 68 that enables a high output can be provided.

This structure is effective in the case where high anti-G performance is required in such a case where the X-ray tube apparatus is mounted in the CT apparatus and the centrifugal force from the helical scanning is applied to the X-ray tube.

The embodiments of the present invention have been described, but the present invention is not limited to the above embodiments. For example, in the individual embodiments that are illustrated in FIGS. 1, 4, 8, 9, and 10, the first large-diameter portions 26-1 of the stationary shafts 13, 36, 50, and 61 are provided in the vicinity of the targets 15, 55, and 59. This structure is effective in the case where amount of heat generation of the targets 15, 55, and 59 is large. However, when amount of heat generation of the second radial bearing 24-2 is large, for example, in some cases where the rotary cylinders 19 and 39 rotate at the high speed, the wall thickness of the second large-diameter portion 26-2 may be thinned more than the wall thickness of the first large-diameter portion 26-1. As such, the portions where the wall thickness is thinned in the stationary shafts 13, 36, 50, and 62 are preferably provided in the vicinity of the portions where the amount of heat generation is large.

In addition, the portions where the wall thickness is thinned may be provided at arbitrary places as long as the each of the portions is provided to become an element constituting the hydrodynamic bearing. For example, in the X-ray tube 11 according to the first embodiment, in the case of the structure in which the stationary shaft 13 covered by the rotary cylinder 19 are entirely provided to have the larger diameter than the other portions of the stationary shaft 13, the radial bearing is configured by the large-diameter portions, the rotary cylinder 19, and the liquid metal 23 interposed between the large-diameter portions and the rotary cylinder. In this case, the portions where the wall thickness is thinned may be arbitrary portions of the large-diameter portions.

The thickness and the length of the portions, such as the first large-diameter portion 26-1 and the second large-diameter portion 26-2, where the wall thickness is thinned, may be set to a degree to which desired characteristics are obtained, in consideration of the heat transfer efficiency and the anti-G performance, and are not particularly limited. Accordingly, as in the X-ray tube 49 according to the third embodiment illustrated in FIG. 5, when the target 15 is disposed at the central position of the first and second cooling baths 31-1 and 31-2 in the structure where the stationary shaft 45 has the first cooling bath 31-1 and the second cooling bath 31-2, the wall thickness of the first large-diameter portion 26-1 and the wall thickness of the second large-diameter portion 26-2 may be formed to have the same thickness. In this case, the first large-diameter portion 26-1 and the second large-diameter portion 26-2 are formed to have the same level of heat transfer efficiency.

Further, the shapes and the sizes of the cooling baths 31, 41, 48, and 53 and the first and second cooling baths 31-1 and 31-2 may be set to a degree to which desired characteristics are obtained, in consideration of the heat transfer efficiency and the anti-G performance, and are not particularly limited. For example, the cooling baths 31, 41, 48, and 53 and the first and second cooling baths 31-1 and 31-2 may have a shape in which the sides of the cooling baths 31, 41, 48, 53, 31-1, and 31-2 are expanded in a tapered shape. As such, if the cooling baths 31, 41, 48, 53, 31-1, and 31-2 are formed in the tapered shape, pressure loss can be decreased due to smoother flow of the cooling fluid. Since the high-temperature cooling fluid can be suppressed from being stagnated in the individual cooling baths 31, 41, 48, 53, 31-1 and 31-2, heat transfer efficiency can be improved.

Figure 14:
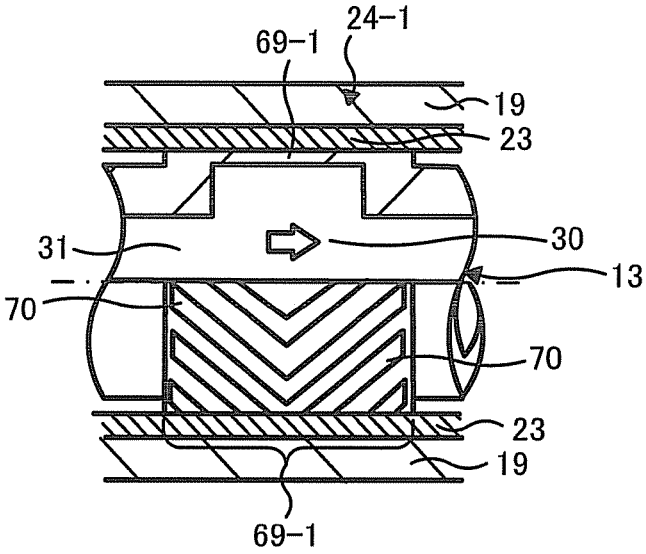
FIG. 14 is an enlarged half cross-sectional view illustrating a modification of the radial bearing illustrated in FIG. 2.

The groove shape and the pattern that cause the hydrodynamic effect to be generated in the first and second radial bearings 24-1 and 24-2 are not limited to the groove shape and the pattern illustrated in FIG. 2. For example, the groove shape and the pattern may be a groove shape and a pattern where the plane region 32 is not provided. FIG. 14 is an enlarged lateral view illustrating a modification of a groove shape and a pattern that are provided in a first large-diameter portion 69-1. As illustrated in FIG. 14, in the first large-diameter portion 69-1, plural grooves 70 having a V shape are provided in a form of patterns of a constant interval along a rotation direction of the rotary anode 14. In this case, since the liquid metal 23 is fed between the first large-diameter portion 69-1 and the rotary cylinder 19, particularly, to portions near the centers of the grooves 70 having a V shape, the hydrodynamic effect can be securely generated in the corresponding portions. However, since the plane region 32 is not provided, the pressure based on the wedge effect is not generated. Accordingly, as compared with the first radial bearing 24-1 illustrated in FIG. 2, reliability of the support of the rotary anode 14 is lowered when the centrifugal force is applied. However, in the case of the X-ray tube where the high load carrying capacity is not needed in the bearing, the first radial bearing that uses the first large-diameter portion 69-1 having the groove shape and the pattern illustrated in FIG. 14 as one element may be applied.

In the first and second large-diameter portions 26-1, 26-2, and 69-1, the grooves 34 and 70 illustrated in FIGS. 2 and 14 may not be provided. In this case, the rotary anode 14 is rotatably supported to the stationary shaft 13 by the pressure based on the wedge effect.

The groove shape and the pattern that are provided in the flange portions 13-1, 36-1, 42-1, 45-1, 50-1, and 62-1 of the stationary shafts 13, 36, 42, 45, 50, and 62 may not necessarily be the groove shape and the pattern illustrated in FIG. 3. For example, in the flange portions 13-1, 36-1, 42-1, 45-1, 50-1, and 62-1, the groove shape and the pattern that are provided radially in an external direction from the centers may be provided.

Each of X-ray tubes according to the third to eighth embodiments has the so-called both-end supported structure, but may has the so-called cantilevered structure. In this case, the anti-G performance is deteriorated as compared with the X-ray tubes having the both-end supported structure. However, if the cantilevered structure is applied to the X-ray tubes where high anti-G performance is not required, the same effects as those in the individual embodiments can be obtained.

While certain embodiments have been described, these embodiments have been presented by way of example only, and are not intended to limit the scope of the inventions. Indeed, the novel embodiments described herein may be embodied in a variety of other forms; furthermore various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary anode X-ray tube, comprising:

a stationary shaft that has a large-diameter portion provided in a portion of the stationary shaft and is provided with a flow passage through which a cooling fluid flows, the large diameter portion having a larger diameter than a diameter of the stationary shaft;

a cooling bath that is provided by thinning the wall thickness of the large-diameter portion to increase the flow passage diameter of a portion of the flow passage and the large-diameter portion located above a radial bearing;

a rotary cylinder that covers an area of the stationary shaft including the large-diameter portion via a liquid metal and is rotatably supported to the stationary shaft;

a target having a hollow circular plate shape that is provided on an outer circumferential surface of the rotary cylinder;

a cathode that is disposed to face the target; and a vacuum enclosure that stores the stationary shaft, the rotary cylinder, the target, and the cathode and supports the stationary shaft, wherein the cooling bath has a columnar portion that is formed in a portion of the stationary shaft, in a state where the stationary shaft and a central axis are aligned, the large-diameter portion is composed of a cylindrical small-thickness portion provided to have a constant gap between the columnar portion and the small-thickness portion, and radial grooves that connect the gap between the columnar portion and the small-thickness portion and the flow passage of the stationary shaft other than the small-thickness portion are provided in both sides of the columnar portion.

2. The rotary anode X-ray tube of claim 1, wherein a sectional area of the flow passage of the stationary shaft, a sectional area of the gap between the columnar portion and the small-thickness portion, and a total sum of sectional areas of the radial grooves provided in both sides of the columnar portion are equal to each other.

* * * * *